US007525492B2

(12) United States Patent
Yu

(10) Patent No.: US 7,525,492 B2
(45) Date of Patent: Apr. 28, 2009

(54) ANTENNA STRUCTURE FOR A NOTEBOOK

(75) Inventor: Yao-Wen Yu, Pa-Te (TW)

(73) Assignee: Auden Techno Corp, Taoyuan Hsien (TW)

( * ) Notice: Subject to any disclaimer, the term of this patent is extended or adjusted under 35 U.S.C. 154(b) by 90 days.

(21) Appl. No.: 11/735,461

(22) Filed: Apr. 14, 2007

(65) Prior Publication Data

US 2008/0252548 A1 Oct. 16, 2008

(51) Int. Cl.
*H01Q 1/24* (2006.01)

(52) U.S. Cl. ..... 343/702; 343/700 MS

(58) Field of Classification Search ..... 343/702, 343/700 MS, 846

See application file for complete search history.

(56) References Cited

U.S. PATENT DOCUMENTS

| | | | | |
|---|---|---|---|---|
| 6,459,413 | B1 * | 10/2002 | Tseng et al. | 343/702 |
| 6,542,123 | B1 * | 4/2003 | Chen | 343/700 MS |
| 6,950,071 | B2 * | 9/2005 | Wen et al. | 343/702 |
| 7,336,229 | B1 * | 2/2008 | Tseng et al. | 343/702 |

* cited by examiner

*Primary Examiner*—Hoang V Nguyen
(74) *Attorney, Agent, or Firm*—Ming Chow; Sinorica, LLC

(57) ABSTRACT

An antenna structure for a notebook comprising a main body of an antenna and a printed circuit board which is provided on the main body of the antenna and is electrically connected; and the printed circuit board is laid out thereon at least with a radio frequency matched line, the radio frequency matched line can be adjusted to get a desired bandwidth.

2 Claims, 3 Drawing Sheets

ANTENNA STRUCTURE FOR A NOTEBOOK

BACKGROUND OF THE INVENTION

1. Field of the Invention

The present invention relates to an antenna structure, and especially to an antenna structure which suits a notebook.

2. Description of the Prior Art

In progression of mobile communication, notebooks get the basic function of mobile communication, and antennas become necessary elements for emitting signals in radio communication. On the requirement of compactness, the interior of a notebook has limited space for receiving an antenna, this makes designing of notebooks in present days encounter a problem of insufficiency of bandwidth desired. Even when a bandwidth is obtained by adjustment by the way of resonance, the original highly efficient structure of the antenna will be destroyed by the fact that a broadband obtained by resonance (resonant bandwidth) is a false resonance, thereby the efficiency of the antenna becomes worse; and this needs improvement.

SUMMARY OF THE INVENTION

The main object of designing of the present invention is to make an antenna structure able to complement the insufficiency of space structurally or the insufficiency of its desired bandwidth to get a better efficiency.

The antenna for a notebook provided by the present invention is composed of a main body of the antenna and a printed circuit board. The printed circuit board is provided on the main body of the antenna and is electrically connected; and is provided thereon with a radio frequency matched line, the radio frequency matched line can be adjusted to get a desired bandwidth and can reduce the influence on the efficiency of the main body of the antenna by space.

The present invention will be apparent in its structure and operational function after reading the detailed description of the preferred embodiment thereof in reference to the accompanying drawings.

DETAILED DESCRIPTION OF THE PREFERRED EMBODIMENT

Figure 1:
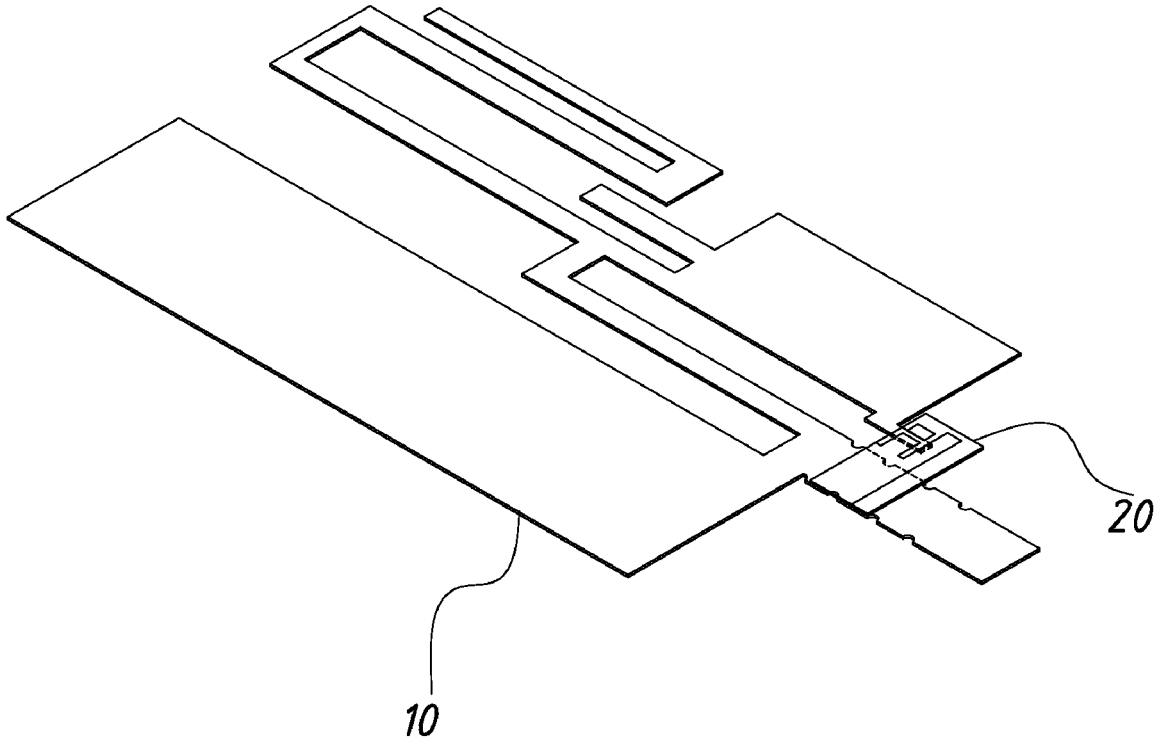
FIG. 1 is a perspective view showing the appearance of the present invention.
Figure 2:
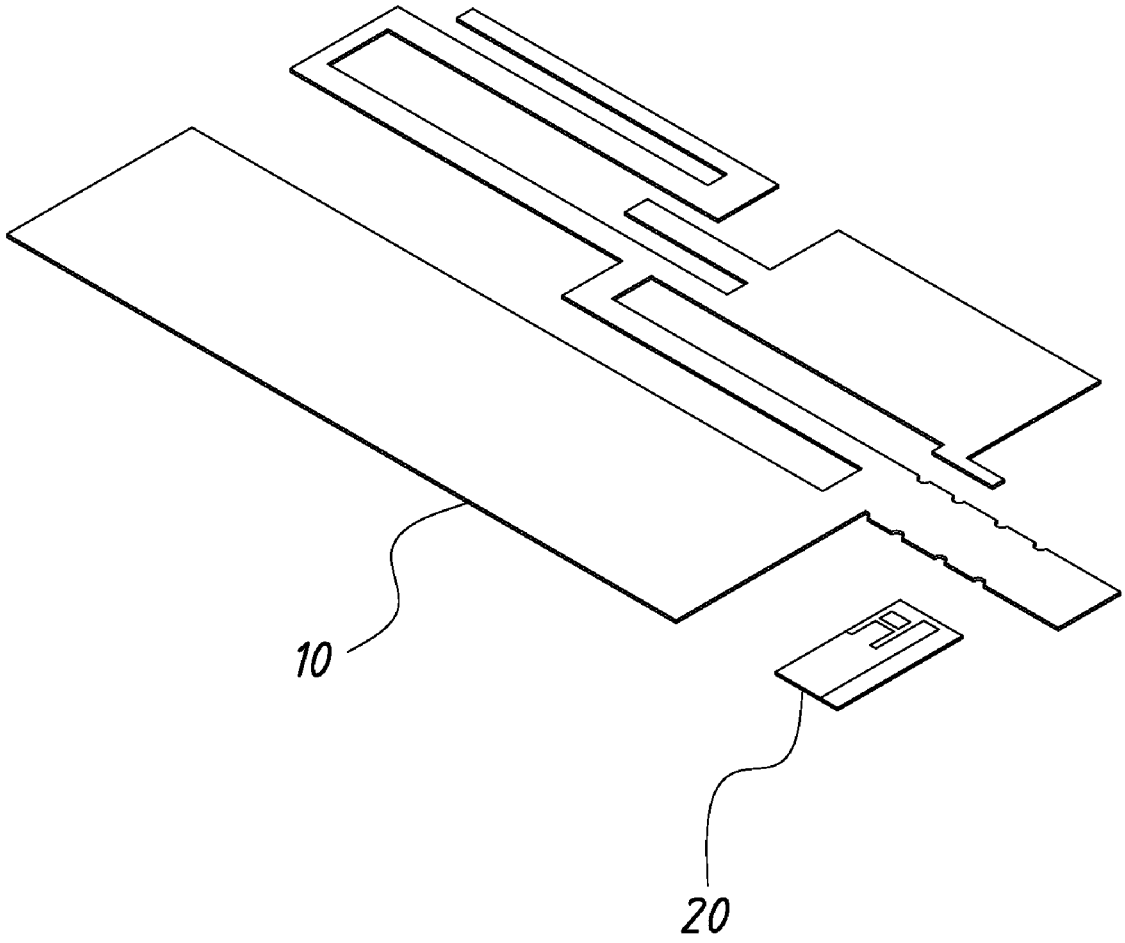
FIG. 2 is a perspective view of the present invention in a detached state.

Referring to FIGS. 1 and 2, an antenna structure of a notebook provided by the present invention is composed of a main body 10 of an antenna and a printed circuit board 20.

The main body 10 of the antenna is made of metal. In the drawing shown, the main body 10 of the antenna is a planar antenna which is provided between a feed-in end and a grounding end with a plurality of cut recesses to form two radiating elements and form different loops in order to become a broad band antenna.

The printed circuit board 20 (PCB) is provided on the main body 10 of the antenna and is electrically connected; and is laid out thereon with a radio frequency (RF) matched line, the radio frequency matched line can be adjusted very easily to get a desired bandwidth that originally is unable obtained by adjustment, thus can reduce the influence on the efficiency of the main body 10 of the antenna by space.

The antenna structure of the present invention renders the main body 10 of the antenna better if the latter is good in function originally, and to be complemented to improve the function if the latter is not good in function originally.

Figure 3:
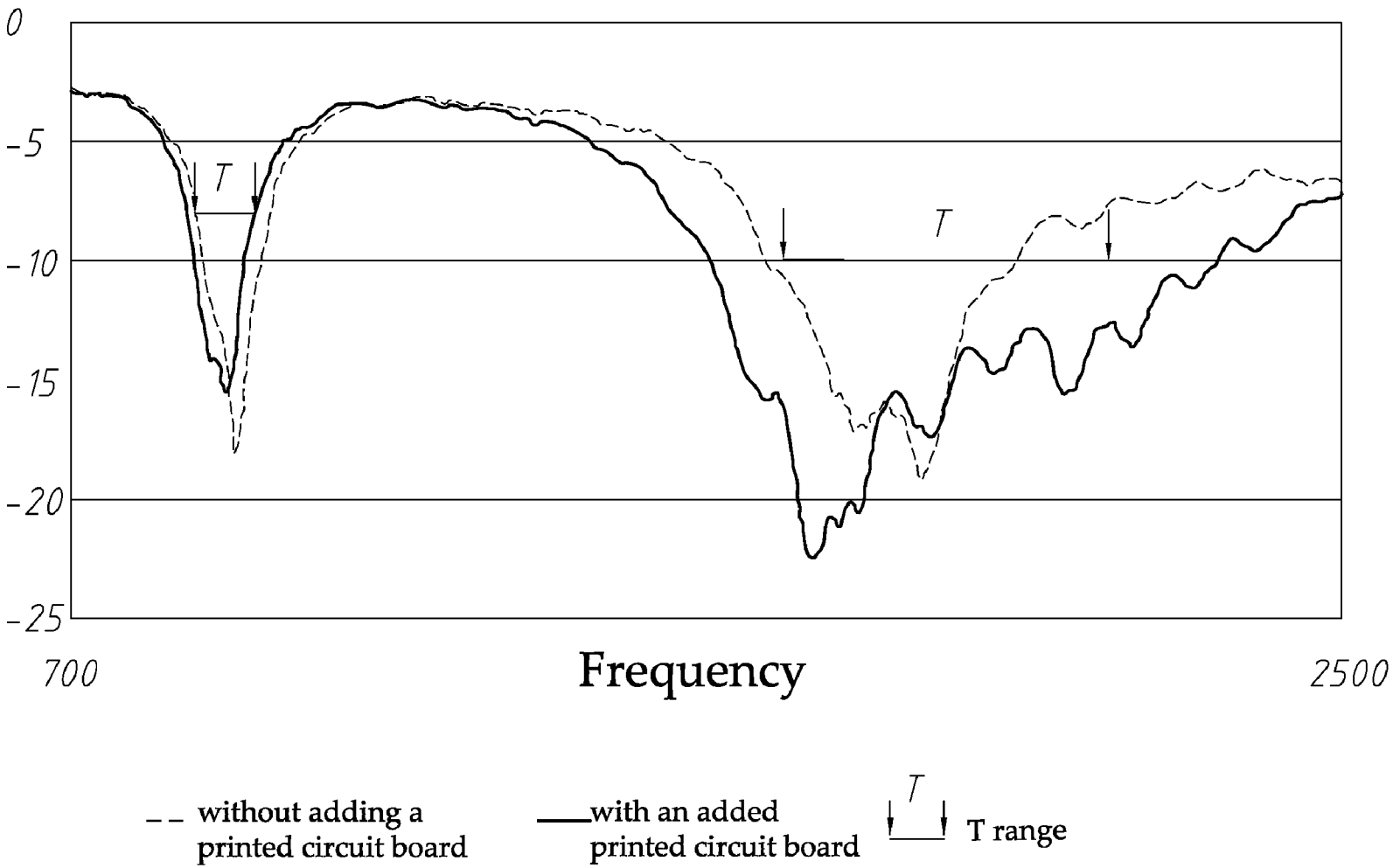
FIG. 3 is a test chart showing the returnloss of the main body of the antenna of the present invention when the printed circuit board is added and not added respectively.

Referring to FIG. 3 which is a test chart showing the returnloss of the main body 10 of the antenna of the present invention when the printed circuit board 20 is added and not added respectively, in the drawing, a range "T" is the desired bandwidth, wherein the main body 10 of the antenna without adding the printed circuit board 20 is insufficient for the high frequency portion, an in the range "T", the main body 10 of the antenna with the added printed circuit board 20 can make its bandwidth increased after matching.

The followings are data for function comparison of a main body of the antenna having an added printed circuit board with a main body of the antenna without adding a printed circuit board respectively:

(1) The main body of the antenna without adding a printed circuit board:

| Frequency (MHz) | 880 | 915 | 960 | 1710 | 1880 | 1990 | 2170 |
|---|---|---|---|---|---|---|---|
| Anttenna Port Input Power (dBm) | 0.00 | 0.00 | 0.00 | 0.00 | 0.00 | 0.00 | 0.00 |
| Total Radiation Power (dBm) | −3.57 | −3.24 | −3.24 | −4.10 | −2.77 | −3.48 | −6.32 |
| Peak EIRP (dBm) | 0.44 | −0.25 | −0.25 | −0.44 | 1.00 | 0.97 | −1.60 |
| Directiviey (dBi) | 4.01 | 2.99 | 2.99 | 3.66 | 3.76 | 4.45 | 4.72 |
| Efficiency (dB) | −3.57 | −3.24 | −3.24 | −4.10 | −2.77 | −3.48 | −6.32 |
| Efficiency (%) | 44.00% | 47.44% | 47.44% | 38.91% | 52.86% | 44.83% | 23.33% |
| Gain (dBi) | 0.44 | −0.25 | −0.25 | −0.44 | 1.00 | 0.97 | −1.60 |
| Average Gain (dB) | −3.57 | −3.24 | −3.24 | −4.10 | −2.77 | −3.48 | −6.32 |
| Mobile efficiency (%) | 44.00% | 47.44% | 47.44% | 38.91% | 52.86% | 44.83% | 23.33% |

(2) The main body of the antenna with an added printed circuit board:

| Frequency (MHz) | 880 | 915 | 960 | 1710 | 1880 | 1990 | 2170 |
|---|---|---|---|---|---|---|---|
| Anttenna Port Input Power (dBm) | 0.00 | 0.00 | 0.00 | 0.00 | 0.00 | 0.00 | 0.00 |

-continued

| | | | | | | | |
|---|---|---|---|---|---|---|---|
| Total Radiation Power (dBm) | −3.50 | −3.20 | −3.47 | −3.13 | −2.95 | −2.96 | −3.24 |
| Peak EIRP (dBm) | −0.57 | 0.58 | 0.12 | 0.39 | 0.11 | 1.75 | 1.46 |
| Directiviey (dBi) | 3.23 | 3.78 | 3.79 | 3.93 | 3.06 | 4.71 | 5.10 |
| Efficiency (dB) | −3.50 | −3.20 | −3.47 | −3.13 | −2.95 | −2.96 | −3.24 |
| Efficiency (%) | 44.63% | 47.87% | 45.00% | 48.60% | 50.72% | 50.59% | 47.46% |
| Gain (dBi) | −0.57 | 0.58 | 0.12 | 0.39 | 0.11 | 1.75 | 1.46 |
| Average Gain (dB) | −3.50 | −3.20 | −3.47 | −3.13 | −2.95 | −2.96 | −3.24 |
| Mobile efficiency (%) | 44.63% | 47.87% | 45.00% | 48.60% | 50.72% | 50.59% | 47.46% |

The above disclosed is a main body of an antenna made of metal added with a small printed circuit board, a radio frequency matched line is made taking advantage of the printed circuit board to complement the insufficiency of the bandwidth of the main body of the antenna and to increase the function of the antenna. Any value of frequency can be used with the antenna structure of the present invention.

Having now particularly described and ascertained the novelty and improvement of my invention and in what manner the same is to be performed, what we claim will be declared in the claims followed.

The invention claimed is:

1. An antenna structure for a notebook comprising:

a main body of an antenna made of metal wherein the main body is provided between a feed-in end and a grounding end with a plurality of cut recesses;

a printed circuit board provided on said main body of said antenna and being electrically connected; and said printed circuit board is laid out thereon at least with a radio frequency matched line, said radio frequency matched line is adapted to being adjusted to get a desired bandwidth; and said main body of said antenna is a planar antenna.

2. The antenna structure for a notebook of claim 1, wherein the printed circuit board is physically detached from the main body.

* * * * *